US006179723B1

(12) United States Patent
Evans

(10) Patent No.: US 6,179,723 B1
(45) **Date of Patent: *Jan. 30, 2001**

(54) METRONOME TIMING AND TEMPO GOLF SWING AID

(75) Inventor: Darryl M. Evans, 400 Arroyo Ave., San Leandro, CA (US) 94577

(73) Assignee: Darryl M. Evans, Pleasanton, CA (US)

( * ) Notice: Under 35 U.S.C. 154(b), the term of this patent shall be extended for 0 days.

This patent is subject to a terminal disclaimer.

(21) Appl. No.: 09/059,731

(22) Filed: Apr. 13, 1998

Related U.S. Application Data

(60) Provisional application No. 60/043,543, filed on Apr. 14, 1997.

(51) Int. Cl.[7] ..... A63B 57/00; A63B 69/36
(52) U.S. Cl. ..... 473/219; 473/278
(58) Field of Search ..... 473/219, 278

(56) References Cited

U.S. PATENT DOCUMENTS

D. 368,949 * 4/1996 Evans et al. ..... 473/219 X
3,599,982 * 8/1971 Elesh ..... 473/278

* cited by examiner

*Primary Examiner*—Jeanette Chapman
*Assistant Examiner*—M. Chambers
(74) *Attorney, Agent, or Firm*—Townsend and Townsend and Crew LLP

(57) ABSTRACT

A golf club-like golf swing training aid comprising a user-settable metronome at the end of a golf club shaft. The metronome produces a periodic signal, typically a sound, to provide a proper tempo for the golfer practicing his or her golf swing. Bristles, or similar material, are preferably provided at the end of the training aid. The bristles brush against the mat over which the golfer swings the training aid. When the timing and tempo are proper, the brushing sound from the bristles engaging the mat coincides with the signal from the metronome.

7 Claims, 3 Drawing Sheets

METRONOME TIMING AND TEMPO GOLF SWING AID

CROSS-REFERENCE TO RELATED APPLICATIONS

This application is related to U.S. Design Patent No. 368,949 issued Apr. 6, 1996, and claims the benefit U.S. Provisional Application No. 60/043,543, filed Apr. 14, 1997, the disclosures of which are incorporated by reference.

BACKGROUND OF THE INVENTION

Golf is a sport of skill and technique in which small changes to one's swing can make large differences in the effectiveness of the swing. An important part of the golf swing is its timing and tempo. Metronomes have been used to help the golfer time his or her swing to help create a smoother swing.

SUMMARY OF THE INVENTION

A golf club-like golf swing training aid includes a metronome at the end of a golf club shaft. The metronome produces a periodic signal, typically a sound, to provide a proper tempo for the golfer practicing his or her golf swing. Bristles, or similar material, are preferably provided at the end of the training aid. The bristles brush against the mat over which the golfer swings the training aid. When the timing and tempo are proper, the brushing sound from the bristles engaging the mat coincides with the signal from the metronome.

BRIEF DESCRIPTION OF THE DRAWINGS

FIG. 1B is a partial cross-sectional view showing the opposed brush and mat of FIG. 1;

DESCRIPTION OF THE SPECIFIC EMBODIMENT

Figure 1A:
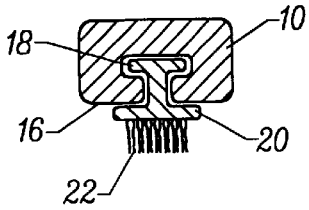
FIG. 1A is a cross-sectional view taken along line 1A—1A of FIG. 2.
Figure 1:
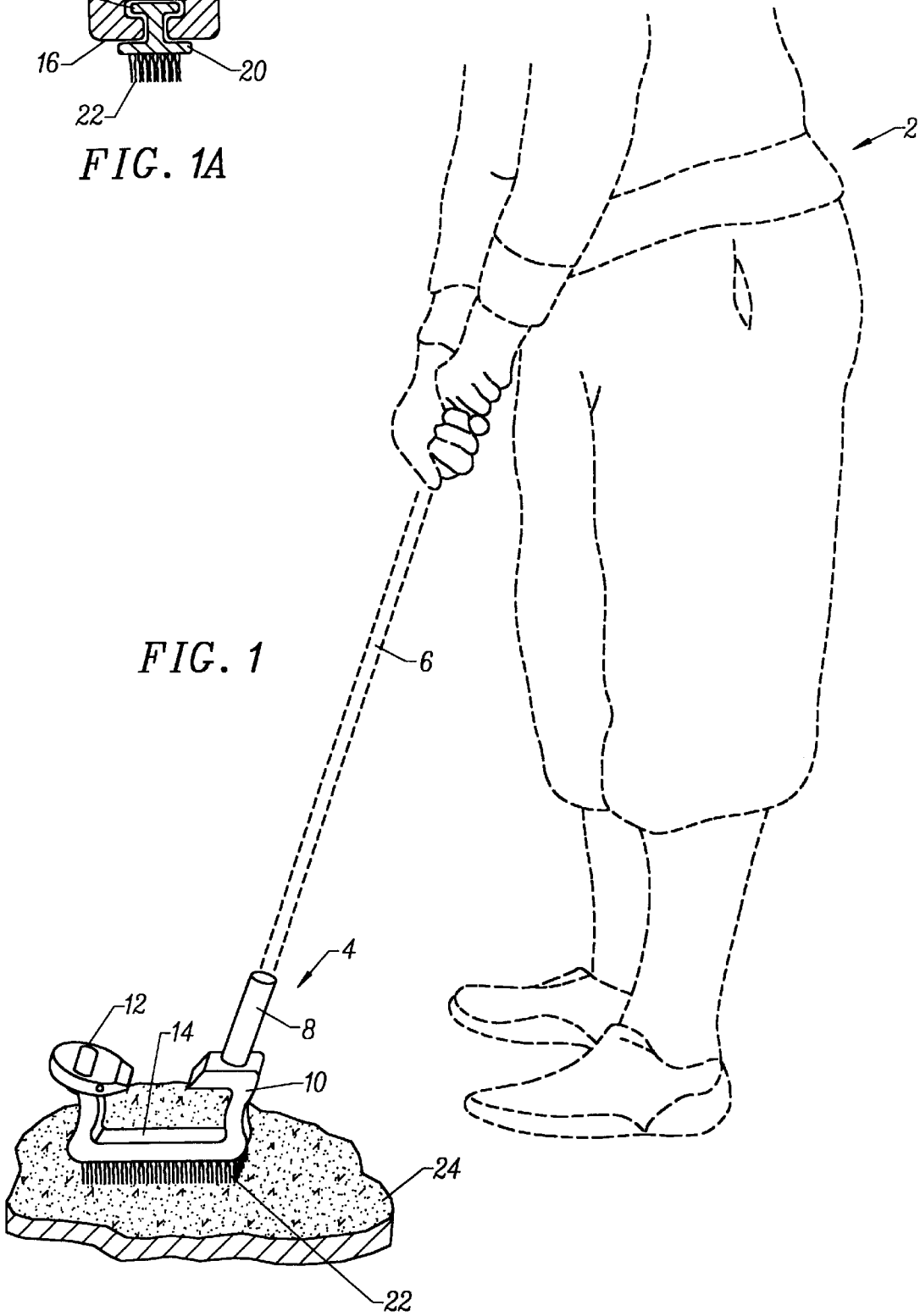
FIG. 1 is an overall view of a golf swing training aid made according to the invention.
Figure 2:
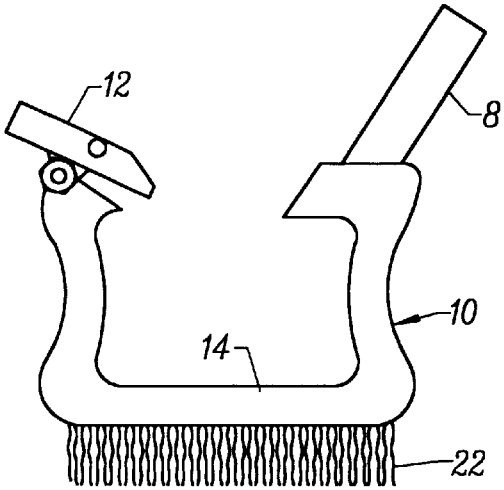
FIGS. 2, 3, 4, 5, and 6 are various views of one embodiment of the training aid of FIG. 1.
Figure 3:
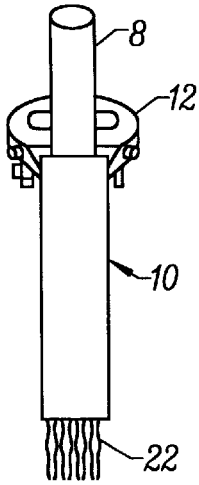
Figure 4:
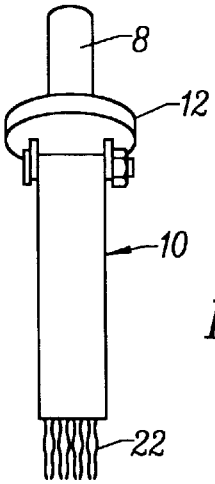

FIG. 1 shows a golfer 2 using a golf swing training aid 4 mounted the end of a club shaft 6 by a mounting tube 8. The training aid 4 includes a generally U-shaped body 10 having the club shaft 6 mounted to and extending upwardly from one end through the mounting tube 8 and an electronic metronome 12 connected to the other end. The base 14 of the body 10 has a lower surface 16 with a tee slot 18, see FIG. 1A, to which a brush 20 having downwardly extending bristles 22 can be removably mounted. This permits the brush to be easily replaced when worn out or when a different type, length or stiffness of bristles are desired. As illustrated in FIG. 1 and in FIG. 7, the training aid 4 is used in conjunction with a mat 24, typically of the same material as the brush; see FIG. 1B. One such material which can be used is sold by Monsanto for use as doormats and in the teeing areas at driving ranges.

Figure 5:
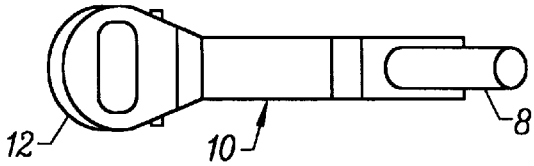
Figure 6:
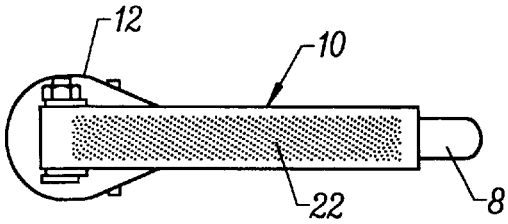

In use, the mat 24 is placed in an area where there is enough room for a full swing. The metronome 12 is set to a desired tempo. The metronome 12 is preferably of a conventional type which can have the frequency of the beeps per minute adjusted to the desired rate, such as with buttons 25; see FIG. 5. While swing tempo for different people will be different, a beginning swing tempo of 50 beeps per minute is often appropriate.

Figure 7:
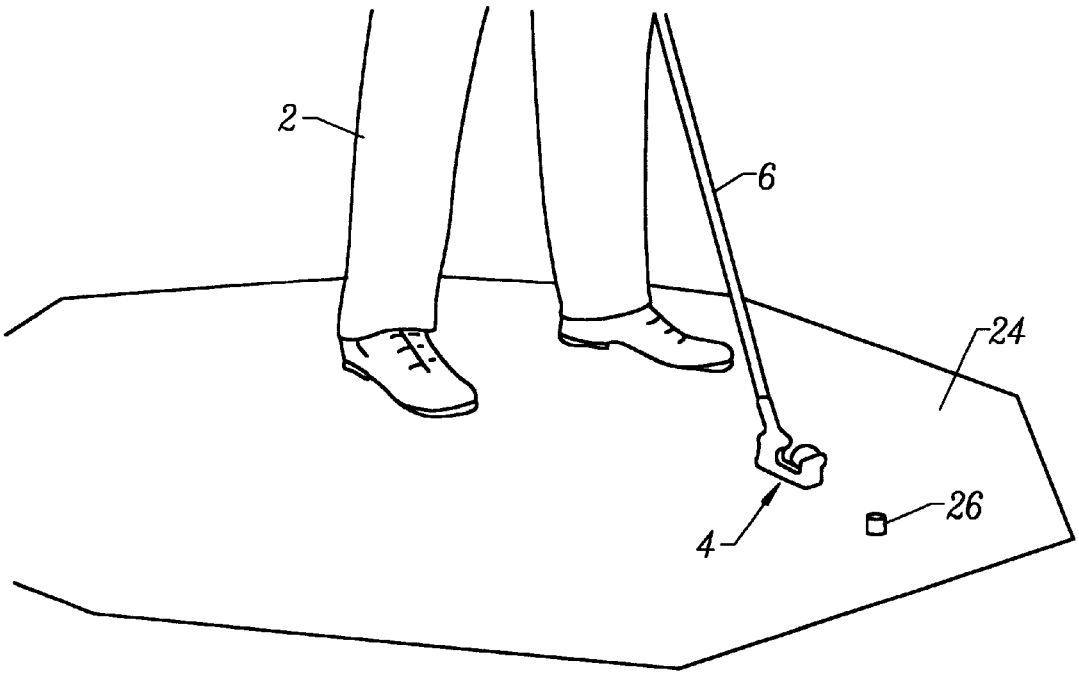
FIG. 7 is an overall view similar to FIG. 1 but also showing a center-of-swing indicator.

The training aid 4, which acts as a golf club head, is placed at about the center of the mat 24. The mat 24 may have a center-of-swing indicator 26 as shown in FIG. 7. The golfer assumes a proper and comfortable stance and hand grip on the club shaft 6. With the metronome 12 continuously beating, the golfer 2 begins taking short swings no higher than the knees, so that the bristles 22 will brush the mat 24 at the exact same time as the metronome beeps. This is done in a continuous pendulum type motion back and forth.

Once the golfer 2 feels comfortable with the short swing matching the tempo of the metronome 12, the golfer 2 extends the swing to hip (half swing) level. Thereafter, a full swing motion can be used. The golfer 2 will notice that to continue the set tempo of the metronome 12, the golfer 2 will need to increase the club head speed as the arc length increases. If the golfer 2 has difficulty keeping in time with the tempo of the metronome 12, the metronome 12 should be set at a slower tempo.

If the golfer 2 is at a correct tempo, the brushing sound of the club head should effectively muffle the beep of the metronome. The golfer 2 thus obtains both a visual and a tactile feedback of a proper swing action to train and condition physical memory reaction. Doing so should create a physical memory to aid in the proper swing in playing golf.

It is believed that the use of the metronome 12 mounted to the body 10 of the training aid 4 provides advantages over a metronome 12 mounted elsewhere. The sound emanates from the same position as the club head so that the audio and visual concentration is directed to the same position. Also, using bristles 22 has an additional advantage over the use, for example, a rubber or other flexible tee to indicate the striking of the ball. Rather than getting just a spike type of sound feedback, as occurs when a solid tee is struck, the engagement of the bristles 22 provides more of a continuously varying sound spectrum.

As an alternative to mounting the metronome 12 to the body of the training aid 4, the metronome 12 could be positioned in alignment with the tee area of the mat, that is where a tee would be placed if a golf ball were being struck with a regular club head. In some situations it may be desirable to mount the metronome 12 to the club shaft 6. Also, the training aid 4 could be used as is to actually strike a ball for putting practice.

Modification and variation can be made to the preferred embodiment without departing from the subject of the invention as defined by the following claims. For example, the metronome 12 preferably emits a beep or other periodic sound. It could also produce a visual indication, such as a flash of light, instead of or in addition to the periodic sound. In appropriate cases the bristles or bristle-like material could be carried by the mat in addition to or instead of by the training aid 4.

What is claimed is:

1. A golf swing training aid assembly comprising:

a golf club shaft having an upper end and a lower end; and a golf swing training aid secured to the lower end of the golf club shaft, said training aid comprising a user-settable, metronome configured to produce a periodic signal with a chosen interval between each signal.

2. The golf swing training aid assembly according to claim 1 wherein said metronome produces a periodic sound signal.

3. The golf swing training aid assembly according to claim 1 wherein the golf swing training aid further comprises bristles extending away from said shaft.

4. The golf swing training aid assembly according to claim 3 further comprising a mat having upwardly-extending elements with which said bristles engage during use of said training aid.

5. The golf swing training aid assembly according to claim 4 wherein said upwardly-extending elements comprise mat bristles.

6. The golf swing training aid assembly according to claim 5 wherein said shaft assembly bristles and said mat bristles are of generally equivalent bristle material.

7. A golf swing training aid comprising:

a body mountable to the lower end of a golf club;

a metronome mounted to the body and configured to provide a periodic signal with a chosen interval between each signal; and bristles extending from the body.

* * * * *